US006126005A

United States Patent [19]

Long, Jr.

[11] Patent Number: 6,126,005

[45] Date of Patent: Oct. 3, 2000

[54] BANDOLIER STRIP SPLICE ASSEMBLY

[75] Inventor: Clarence S. Long, Jr., Colfax, N.C.

[73] Assignee: The Whitaker Corporation, Wilimngton, Del.

[21] Appl. No.: 09/037,670

[22] Filed: Mar. 10, 1998

Related U.S. Application Data

[60] Provisional application No. 60/040,514, Mar. 13, 1997.

[51] Int. Cl.[7] ..... B65D 85/66

[52] U.S. Cl. ..... 206/390; 24/329; 24/580; 206/820; 29/525.01; 29/759

[58] Field of Search ..... 29/809, 525.01, 29/453, 759; 198/844.2; 24/31 R, 35, 36, 339, 329, 580; 206/820, 345, 338, 390, 343

[56] References Cited

U.S. PATENT DOCUMENTS

| | | | |
|---|---|---|---|
| 369,023 | 8/1887 | Newell | 24/35 |
| 1,706,354 | 3/1929 | Geist | 24/35 |
| 3,043,902 | 7/1962 | Klein | 174/176 |
| 3,885,669 | 5/1975 | Potucek | 206/338 |
| 4,505,395 | 3/1985 | Nathan | 211/126 |
| 5,133,847 | 7/1992 | Boyd | 204/198 |

FOREIGN PATENT DOCUMENTS

| | | | |
|---|---|---|---|
| 0 501 392 A2 | 5/1994 | European Pat. Off. | H01R 43/16 |
| 8336724 | 2/1986 | Germany | H01R 43/00 |
| 06150997 | 10/1992 | Japan | H01R 13/02 |

*Primary Examiner*—David P. Bryant
*Assistant Examiner*—Jermie E. Cozart

[57] ABSTRACT

A bandolier splice assembly 10 includes at least two bandoliers 20 connected by a splice member 30. Each bandolier 20 includes a bandolier strip with electrical contacts 20 secured at regular intervals by retaining sections 23. The splice member 30 is inserted into the trailing end of a first bandolier and into the leading edge of a second bandolier so that the electrical contacts 24 can be continuously fed to an assembly machine or operating station without any down time for changing bandoliers 20. The flat splice member 30 includes resilient legs 33 separated from the remaining body of the splice member 30 by slots. Each leg 33 includes a tooth 37 with inclined camming surface 38 for deflecting the flexible leg 33 and a gripping surface 39 to engage endmost retaining sections 23. A splice stop member 36 positions the two bandoliers 20 relative to each other so that the electrical contacts continue to spaced on the same regular intervals for sequential input to an operational station or machine.

9 Claims, 5 Drawing Sheets

BANDOLIER STRIP SPLICE ASSEMBLY

CROSS REFERENCE TO PENDING APPLICATIONS

This application claims benefit of the filing date of Provisional Patent Application Ser. No. 60/040,514 filed on the date of Mar. 13, 1997 identifying Clarence S. Long, Jr. as the inventor.

BACKGROUND OF THE INVENTION

1. Field of the Invention

The present invention relates to a splice member for joining two strips of material, the strips including electrical terminals mounted thereon. More particularly, this invention is directed to a splice member for use with bandolier terminal strips of the types used in the assembly of electrical connectors.

2. Description of the Prior Art

Conventional bandolier strips are adapted for supplying component parts to manual, semi-automatic, or fully automatic manufacturing machines; for example, an automatic insertion machine for inserting electrical contacts into an electrical connector. Conventional bandoliers typically comprise part of a bandolier feed reel whereby, when the reel runs to its end, conventional procedure requires that the insertion machine must be shut down for a period of time to allow for connection of a new bandolier reel. During this time, the connection between bandoliers is conventionally made by welding, wiring, and/or taping methods. The conventional methods are disadvantageous in that they cannot be run through the machine, and so the machine must be stopped while a new reel is fed into the machine. Experience has shown that downtime due to this one problem can equal approximately thirty percent of all down time for assembling bandolier fed electrical contacts into electrical connector housings.

SUMMARY OF THE INVENTION

This invention comprises an assembly for sequentially advancing a plurality of components to an operational location or station, such as an assembly machine, which removes the components from a bandolier and inserts them into an assembly, such as an electrical connector. This assembly can also be used with other equipment or machines, such as a continuous electroplating line.

This assembly includes a first bandolier strip with components, such as electrical contacts, attached to the first bandolier strip. Adjacent components are spaced apart by a constant distance and these centerline spacings permit the components to be fed at a constant rate and on a constant feed length to the assembly machine or other apparatus with which the bandolier strip is used.

A second bandolier strip also has components attached thereto, and adjacent components on the second bandolier are spaced apart by the same constant distance as on the first bandolier strip. The second bandolier strip is identical to the first bandolier strip and serves as a backup while the first bandolier strip is being fed to the operational location or assembly machine.

A splice attaches a trailing edge of the first bandolier strip to a leading edge of the second bandolier strip. The splice engages the first and second bandolier strips to position a last component on the first bandolier strip the same constant distance from the first component on the second bandolier strip so that the components can be delivered to the assembly machine or other operational location at the same rate and on the same intervals or centerline spacings without interruption, or without machine or process downtime to load the second bandolier or attach it to the first bandolier. The splice member can be attached to the first and second bandoliers, while the first bandolier is delivering components, such as electrical connectors, at a prescribed operational rate.

DETAILED DESCRIPTION OF THE INVENTION

Figure 1:
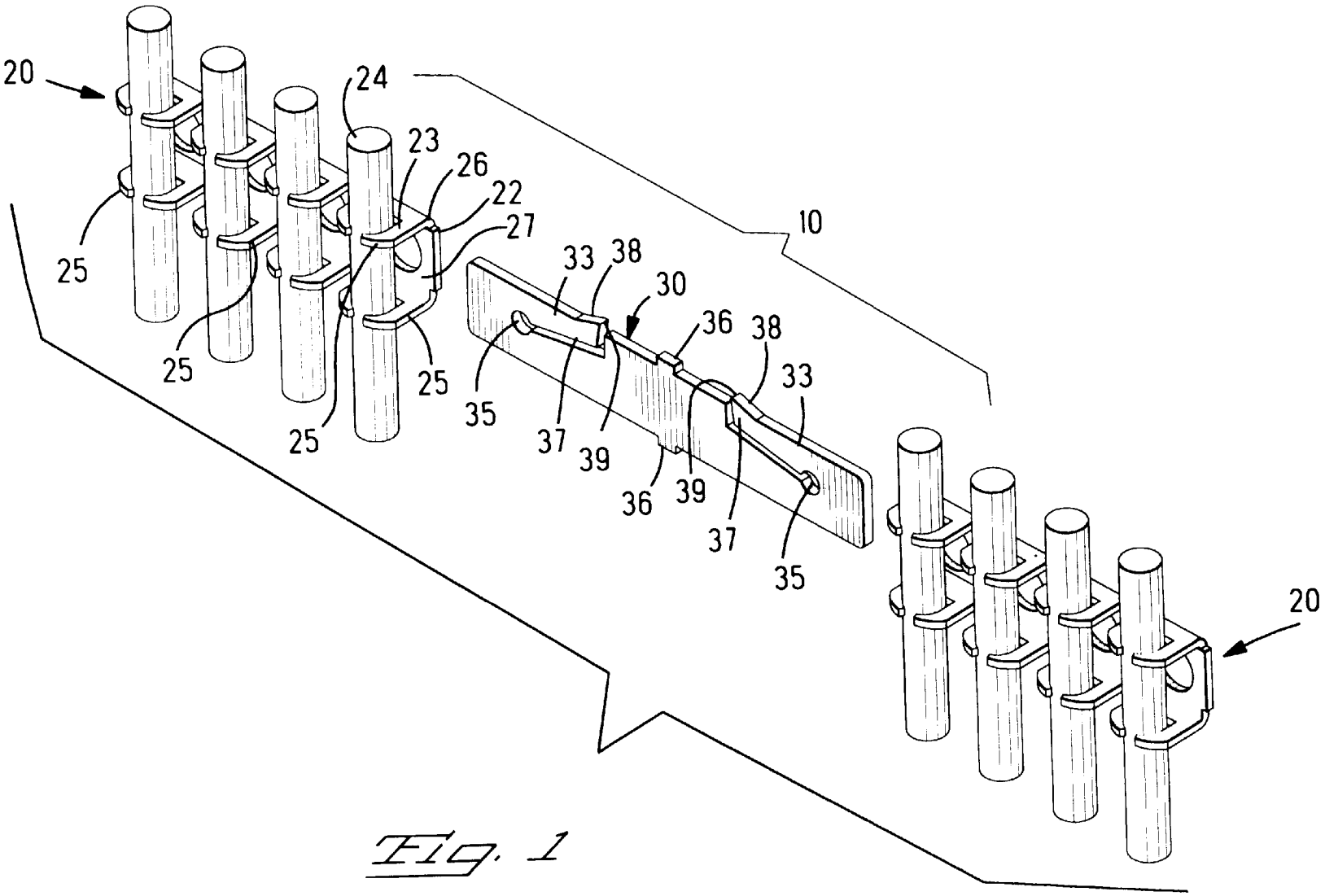
FIG. 1 shows an isometric view of the splice assembly according to the present invention, in a pre-staged state, comprising bandolier strips and a first embodiment splice member according to the present invention.
Figure 2:
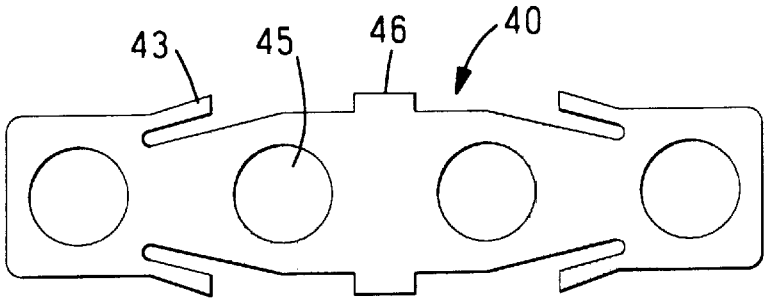
FIG. 2 shows a second embodiment splice member according to the present invention for use in a splice assembly.
Figure 3:
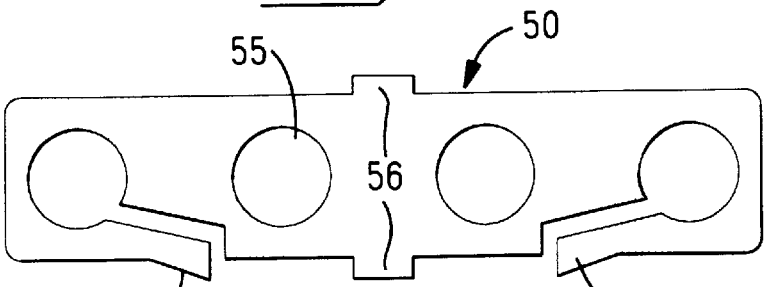
FIG. 3 shows a third embodiment splice member according to the present invention for use in a splice assembly.
Figure 4:
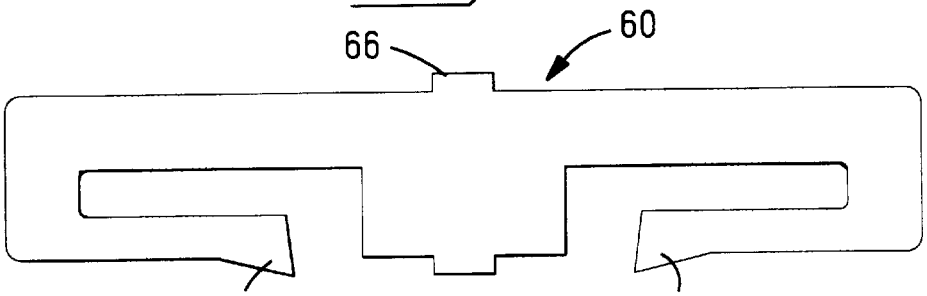
FIG. 4 shows a fourth embodiment splice member according to the present invention for use in a splice assembly.
Figure 5:
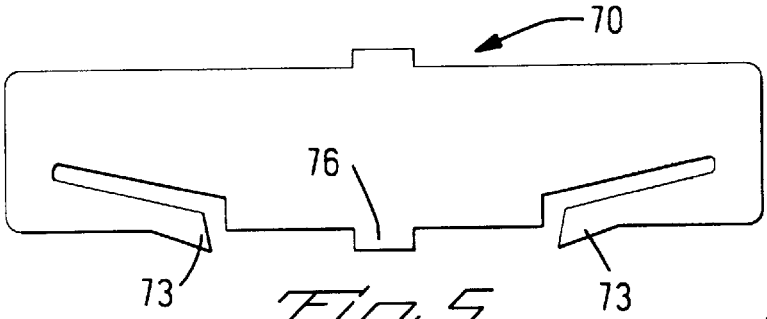
FIG. 5 shows a fifth embodiment splice member according to the present invention for use in a splice assembly.
Figure 6:
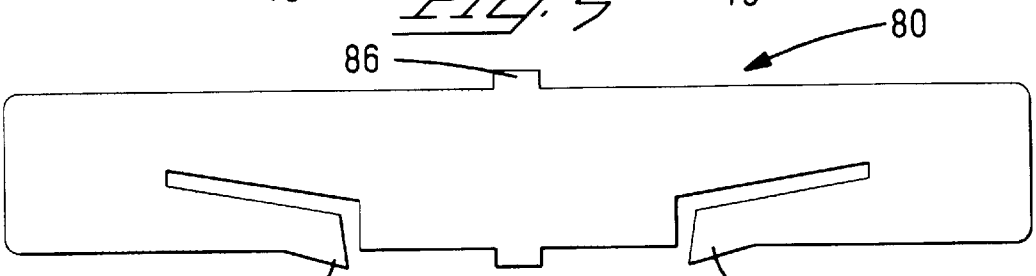
FIG. 6 shows a sixth embodiment splice member according to the present invention for use in a splice assembly.

Referring to FIG. 1, a splice assembly 10 according to the present invention will now be described. Splice assembly 10 includes bandoliers 20 and a splice member 30 for reliably connecting bandoliers 20 together. Bandoliers 20 are of a conventional type. Bandolier splice assembly 10 of the present invention comprises a series of conventional bandoliers 20 joined by splice members 30 so that the bandoliers can be run through the machine, no stopping of the machine is required, which thereby advantageously reduces downtime of the machine. To join a first bandolier strip 20 to another bandolier strip 20 on a backup reel, an operator merely inserts one end of a splice member into the trailing end of one bandolier strip 20 and into the leading end of the backup bandolier strip 20.

As shown in FIG. 1, a conventional bandolier 20 comprises a bandolier strip 22 having retaining sections 23 which releasably hold respective electrical contacts 24. This conventional bandolier strip 20 has a rear carrier section 27 with pilot holes that are used to advance the bandolier strip 20. For the conventional bandolier strip 20 depicted herein, retaining sections 23 comprise arms 25 extending from the top and bottom edges of the carrier section 27. Each retaining section 23 includes arms 25 located to engage opposite sides of the electrical contact 24 secured by the retaining section 23. Therefore each retaining section includes two opposed arms 25 at the top and two arms 25 at the bottom. It should be understood however that the conventional bandolier strip 20 depicted herein is only representative of bandolier strips, the details of which can vary depending upon the product carried by the bandolier strip.

Figure 8:
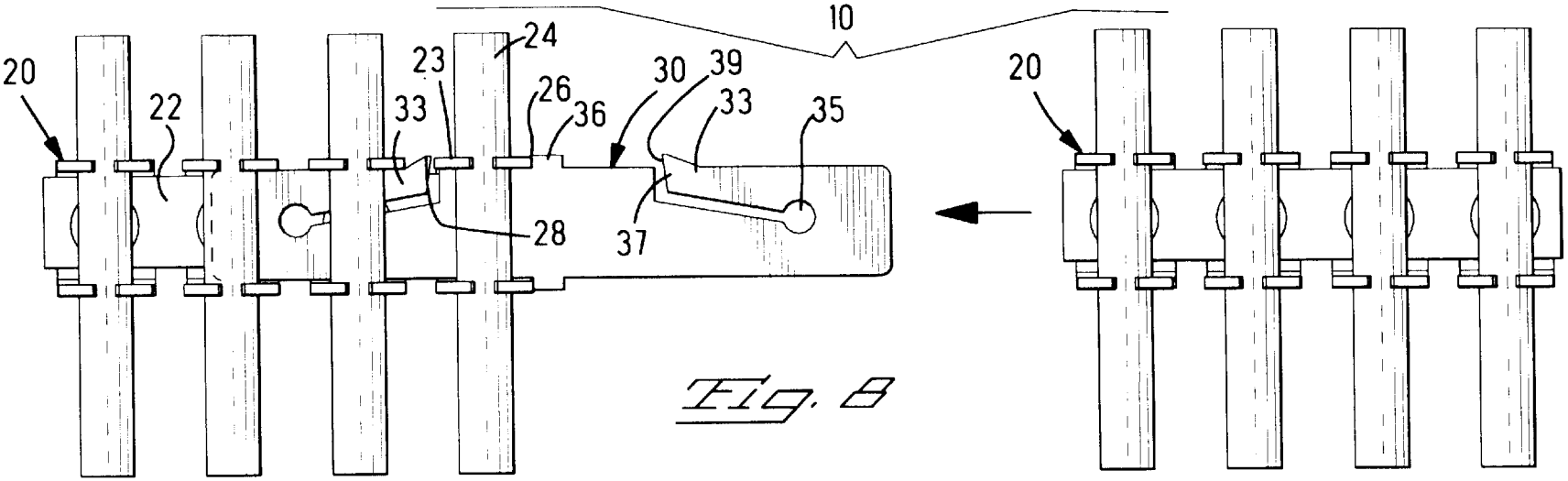
FIG. 8 shows a front view of the intermediate assembly state of FIG. 7.

Each retaining section 23 is separated from adjacent retaining sections by an interstice 28 (FIG. 8). Adjacent retaining sections 20 are spaced apart on prescribed centers so that the electrical contacts can be sequentially fed to the assembly machine. Retaining section 23, at the terminus of strip 22, comprises a facing edge 26. The leading end of the strip 22 would also have and end retaining section 23.

Figure 10:
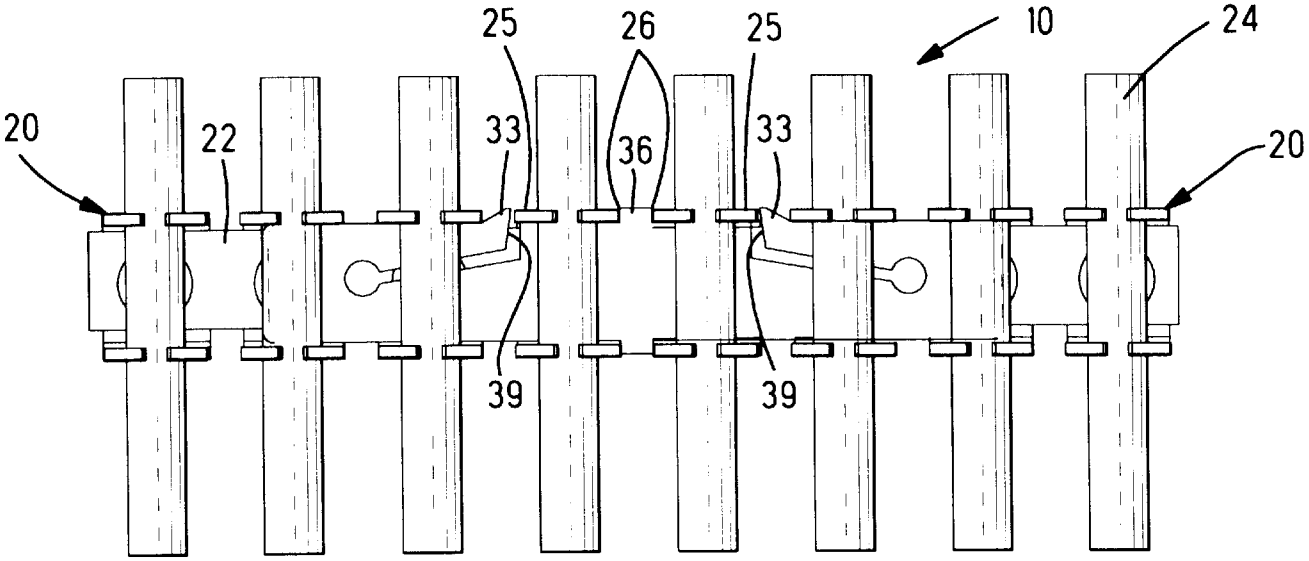
FIG. 10 shows a front view of the splice assembly of the present invention in a fully assembled state.
Figure 11:
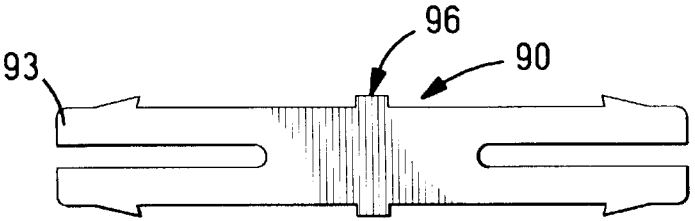
FIG. 11 shows a seventh embodiment splice member according to the present invention for use in a splice assembly.
Figure 12:
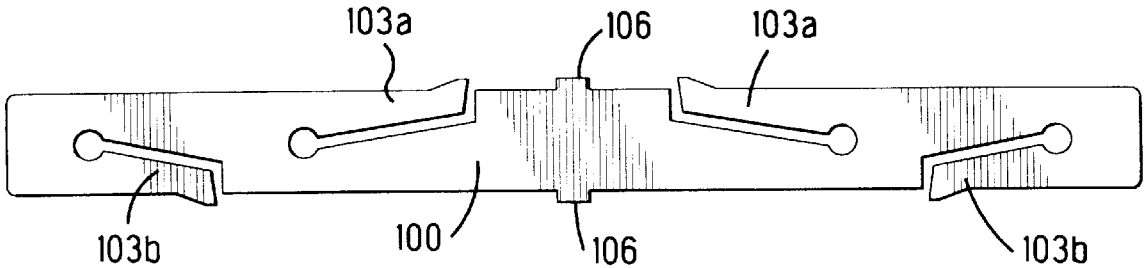
FIG. 12 shows an eighth embodiment of the splice member with opposed resilient legs.

In a preferred embodiment of the splice member according to the present invention, splice member 30 is formed of a metallic material having a suitable spring characteristic, for example, beryllium copper. This preferred embodiment of the splice member 30 is flat. Splice member 30 includes integrally formed, spring members comprising deflectably resilient legs 33. Legs 33 are formed adjacent to respective stress relieving arcuate cutouts 35 at the ends of slots which separate the resilient legs from the remainder of the body of the splice member 30. Each resilient leg includes a tooth 37 located at the free end of the cantilever beam leg 33. Each tooth 37 includes an inclined surface 38 on the outer surface of the tooth 37. A gripping surface 39 is located on the inner end of the tooth 37 adjacent the end of the slot separating the tooth 37 from the remainder of the splice member 30. This gripping surface 39 is steeper than the inclined surface 38 on the opposite side of the tooth 37. In the preferred embodiment of this invention, the distance between this gripping surface 39 and the closest edge of the stop member 36 is equal to the width of a retaining section 23. A set of stop members 36 are disposed in a medial section of splice member 30 between legs 33. The width of these stop members 36 is substantially equal to the width of the interstitial section 28 between adjacent retaining sections 23, which is equal to the spacing between adjacent retaining arms of adjacent retaining sections 23. As shown in FIG. 10 the spacing of gripping surfaces 39 is a function of the spacing between components. In the preferred embodiment shown in FIG. 10, this spacing between gripping surfaces 39 is equal to the spacing between components 24 plus a constant fraction of the width of retaining arms 25. the distance between gripping surfaces 39, and therefore between legs 33, is chosen so that endmost components 24 of the two spliced bandoliers 20 will be located on the same spacings or feed length as components 24 on either bandolier 20.

The splice member according to the present invention comprises other configurations as well. For example, referring to FIGS. 2–6, and 11 and 12 splice member embodiments 40, 50, 60, 70, 80, 90, 100 are shown. Each splice member 40, 50, 60, 70, 80 includes respective resilient legs 43, 53, 63, 73, 83, and stop members 46, 56, 66, 76, 86 medially disposed between the legs. Splice member 90 comprises cantilever beams 93 with a stop member 96. Splice member 100 includes legs 103*a* and 103*b* along the upper and lower edges of the splice member 100 on opposite sides of the central stop member 106. Thus splice member 100 would engage the corresponding bandolier strip 20 along both the top and bottom edges. Splice member embodiments 30, 40, 50, 60, 70, 80, 90, and 100 are adapted for use with differing sizes of bandolier strips, and/or for specific feed mechanisms of a particular machine. For example, splice members 40, 50 include respective pilot holes 45, 55 for engagement with traction pins of a feed wheel (not shown). Moreover, the contours of the splice members of the present invention are configured such that the splice members will pass through a machine without jamming or otherwise interfering with the operation of the machine.

Figure 7:
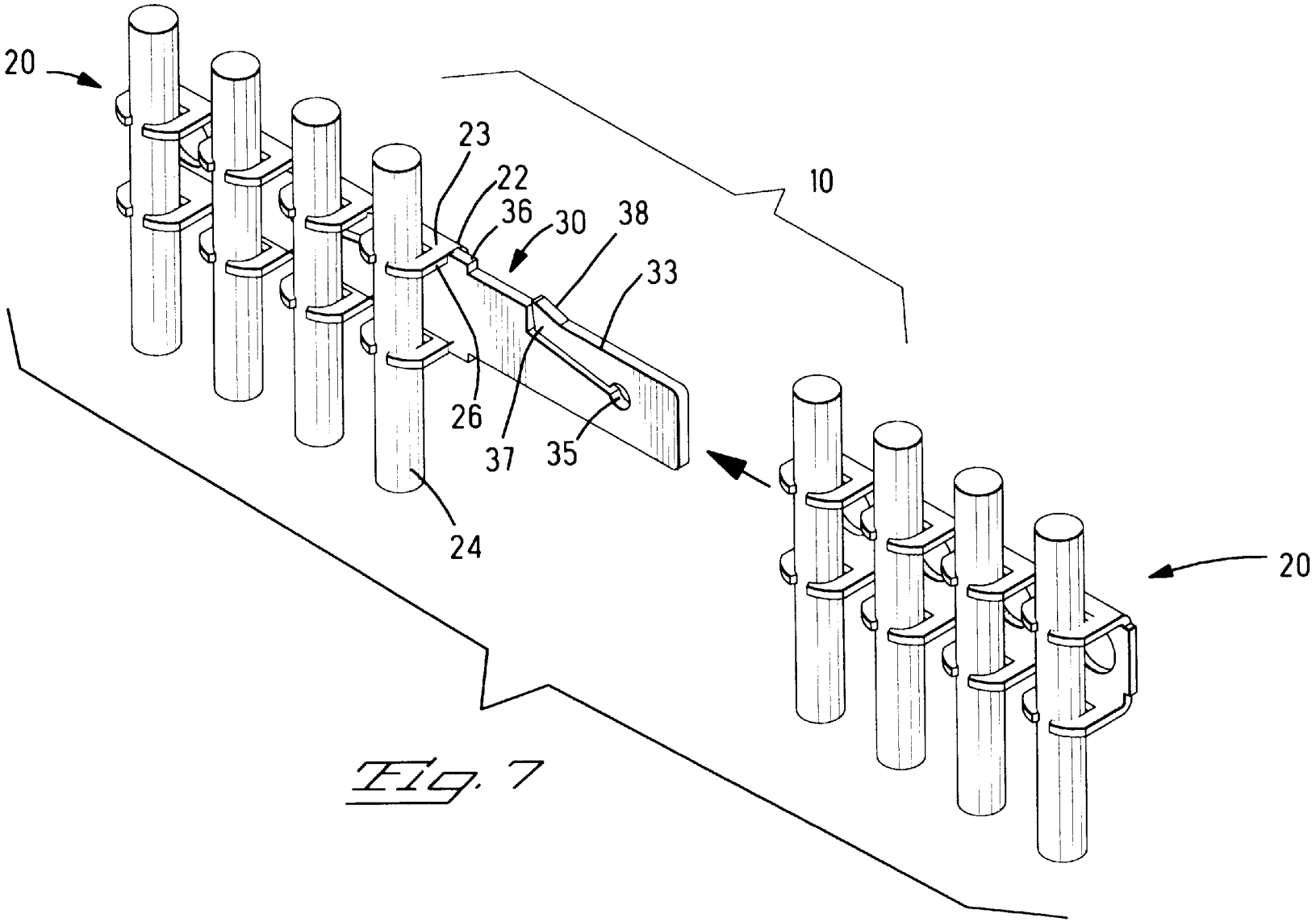
FIG. 7 shows an isometric view of the splice assembly of FIG. 1 in an intermediate assembly state.
Figure 9:
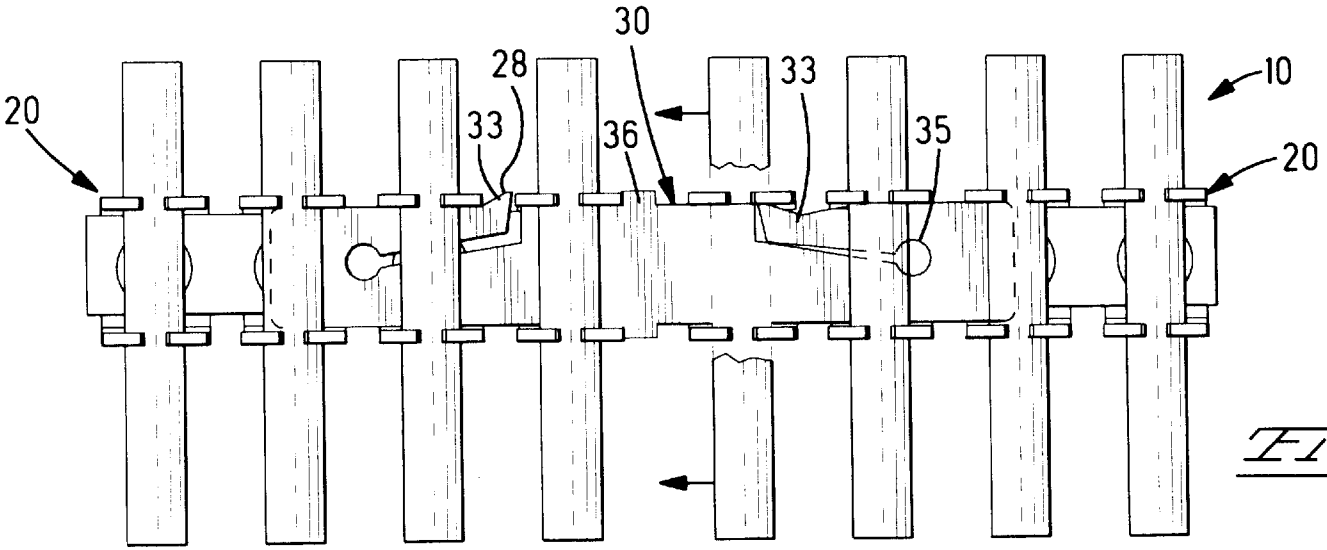
FIG. 9 shows a front view of a post-intermediate assembly state of the assembly of FIG. 1.

Referring to FIGS. 7–10, assembly of the splice assembly 10 utilizing preferred splice member 30 will be described. However, it will be understood by skilled artisans that the embodiments of splice members 40, 50, 60, 70, 80, 90, and 100 can be used to connect bandoliers with a high degree of efficacy. First, splice member 30 is inserted into a bandolier 20 so that one leg 33 is interposed between an electrical contact 24 and bandolier strip 22 (FIG. 7). As this occurs, leg 33 will be resiliently deflected against the inherent spring forces thereof (FIG. 9). Splice member 30 is so inserted into bandolier 20 until stop 36 engages facing edge 26 of one of the retaining section arms 25, at which time leg 33 resiles into generally its original shape, behind retaining section 23, thereby latching splice member 30 to bandolier 20 (FIG. 8). Next, the other bandolier 20 is advanced into latching engagement with the other leg 33 until the facing edge 26 of the endmost retaining arm 25 of the other bandolier generally abuts stop 36 (FIG. 10). At this stage, two retaining sections 23, one on each bandolier 20, are trapped between resilient legs 33. The assembly 10 is thus in a fully assembled state, the bandoliers are reliably connected, and the connected bandoliers are ready to be fed into a manufacturing machine. The splice members engage the retaining section arms 25 so that the endmost retaining sections 23 on the two strips are spaced apart on the same spacing as retaining sections 23 on either strip. Thus the two strips and the ends of the two spliced bandolier strips 20 will be advanced through the assembly or other manufacturing tooling at the same rate, and the contacts 24 or other product secured to the bandolier stripes 20 will be on the same spacing or intervals as the electrical contacts 24 held by intermediate retaining sections. The splice members do not register on the ends of the carrier 27 because those ends are not precisely controlled. Normally the ends of these carriers 27 are merely snipped or cut by an operator.

Although the splice members of the present invention are preferably formed of a metallic material, it will be understood by skilled artisans that the splice member according to the appended claims could perform the desired splicing function where the splice member is formed of a suitable engineering plastic material. Additionally, although the preferred embodiment of the present invention comprises component parts of the electrical contact type, it will be understood by skilled artisans that the splice member according to the appended claims could perform the splicing function in connecting strips of component parts comprising various other articles of manufacture, e.g., pins, fasteners, rods, rings, discs, strips, plates, or etc. Furthermore it will be understood that these splice members and the spliced bandolier subassemblies are not limited to use with assembly equipment or other manufacturing equipment that performs mechanical operations on the electrical contacts or other product carried by the bandolier strips. For example, these splice members can be used in continues electroplating operations.

I claim:

1. An assembly for sequentially advancing a plurality of components to an operational location comprising:

a first bandolier strip with components attached to the first bandolier strip, adjacent components being spaced apart by a constant distance;

a second bandolier strip with components attached to the second bandolier strip, adjacent components being spaced apart by the same constant distance as for said first bandolier strip;

the assembly being characterized by a splice attaching a trailing edge of the first bandolier strip to a leading edge of the second bandolier strip, the splice having two flexible members on opposite ends of said splice for gripping the first and second bandolier strips, without attachment to the components, to position a last component on the first bandolier strip the same constant distance from the first component on the second bandolier strip so that the components can be delivered to the operational location without interruption.

2. The assembly of claim 1 wherein the bandolier strips each include retaining arms extending from a carrier to attach components to the bandolier strips, the splice including gripping surfaces engaging retaining arms on the first and second bandolier strips.

3. The assembly of claim 2 wherein the splice includes a stop member having a width equal to a distance between adjacent edges of adjacent retaining arms attaching adjacent components to the bandolier strips.

4. The assembly of claim 2 wherein the gripping surfaces are spaced apart by a distance which is a constant function of the spacing between adjacent components.

5. The assembly of claim 1 wherein the splice comprises a flat member.

6. The assembly of claim 5 wherein the flexible members comprise legs separated for a body of the splice member by a slot.

7. The assembly of claim 6 wherein each leg includes a tooth at a free end thereof, each tooth including an inclined outer edge and a gripping inner edge.

8. The assembly of claim 7 wherein the gripping inner edge is adjacent to the slot between the leg and the body of the splice member.

9. The assembly of claim 1 wherein the splice member is insertable into the trailing end of the first bandolier strip and into the leading end of the second bandolier strip.

* * * * *